US005708947A

United States Patent [19]

Kagawa et al.

[11] Patent Number: 5,708,947

[45] Date of Patent: Jan. 13, 1998

[54] TONER IMAGE FIXING DEVICE

[75] Inventors: Toshiaki Kagawa; Toshihiro Tamura, both of Sakurai; Shogo Yokota, Fujiidera, all of Japan

[73] Assignee: Sharp Kabushiki Kaisha, Osaka, Japan

[21] Appl. No.: 781,179

[22] Filed: Dec. 20, 1996

[30] Foreign Application Priority Data

Dec. 26, 1995 [JP] Japan ..... 7-338845

[51] Int. Cl.[6] ..... G03G 15/20

[52] U.S. Cl. ..... 399/328; 219/216

[58] Field of Search ..... 399/328, 330, 399/331, 333, 335, 338, 339; 219/216, 469–471; 432/60; 430/98, 99, 126; 492/46, 59

[56] References Cited

U.S. PATENT DOCUMENTS

| | | | |
|---|---|---|---|
| 4,822,978 | 4/1989 | Morris et al. | 219/216 |
| 4,860,047 | 8/1989 | Pirwitz | 219/216 X |
| 5,046,146 | 9/1991 | Bartman et al. | 219/216 |
| 5,084,738 | 1/1992 | Ishikawa . | |
| 5,212,529 | 5/1993 | Morris et al. . | |
| 5,223,902 | 6/1993 | Chodak et al. | 399/328 X |
| 5,485,259 | 1/1996 | Uehara et al. | 399/322 X |
| 5,499,089 | 3/1996 | Tsukamoto et al. | 399/328 |
| 5,570,171 | 10/1996 | Kusumoto et al. | 399/328 |
| 5,621,510 | 4/1997 | Okuda et al. | 399/338 |
| 5,621,512 | 4/1997 | Uehara et al. | 399/328 |
| 5,655,202 | 8/1997 | Yoshimura et al. | 399/330 |

FOREIGN PATENT DOCUMENTS

| | | |
|---|---|---|
| 196 00 211 A1 | 9/1996 | Germany . |
| 55-36996 | 9/1980 | Japan . |
| 1-304481 | 12/1989 | Japan . |
| 8-241000 | 9/1996 | Japan . |

*Primary Examiner*—Matthew S. Smith

*Attorney, Agent, or Firm*—David G. Conlin; George W. Neuner

[57] ABSTRACT

A toner image fixing device has a heat-resistant sheet that possesses excellent durability, fixing ability, transporting ability and working reliability. In a toner image fixing device that has a fixing roller, a pressure member disposed as pressed against the fixing roller, and a heat-resistant sheet secured between the fixing roller and the pressure member and fixes a toner image on a recording medium by heat while the latter passing through nip portion formed between the fixing roller and the heat-resistant sheet. The heat-resistant sheet is a sheet made of synthetic resin PTFE containing polyimide.

3 Claims, 3 Drawing Sheets

TONER IMAGE FIXING DEVICE

BACKGROUND OF THE INVENTION

The present invention relates to a toner image fixing device that is used in electrophotographic copying machines, facsimiles, printers and the like machines using electrophotographic process.

In conventional electrophotographic copying machines, facsimiles, printers and the like machines using electrophotographic process, there is usually used such a toner image fixing device that fixes a toner image on a recording material passing through nip portion formed between a fixing Poller and a pressure roller, by heating either one or both rollers (hereinafter called "pressure roller type"). In the pressure roller type fixing device, paired rollers must rotate in synchronism with each other and must be rotatably supported. Therefore, the device has a complicated construction and is large and expensive to manufacture. To solve the above-mentioned problems, the present applicant proposed a toner image fixing method that fixes a toner image on recording paper by transferring nip portion formed between a fixing roller and non-rotating pressure member used instead of a pressure roller (Japanese Patent Application No. 7-44647). This method is hereinafter called "pressure pad type".

A pressure pad type toner image fixing device has a fixing roller and a pressure member disposed under the fixing roller. The fixing roller is comprised of a thin-wall aluminum cylinder whose external surface is coated all over with well-releasable, paper-guiding heat-resistant synthetic resin, e.g., heat-resistant silicone rubber having a large friction coefficient. Furthermore, the pressure and pad type toner image fixing device has a pressure member disposed under the fixing roller. A heat-resistant sheet on a lower frame which is interposed between the pressure member and the fixing roller. The heat-resistant sheet is made of a 100 micron thick glass fiber base coated or impregnated with well-releasable and heat-resistant synthetic resin, e.g., fluorocarbon resin: PFA (Tetrafluoroethylene-fluoroalkylvinylether copolymer), PTFE (Polytetrafluoroethylene) and FET (Polytetrafluoroethylene-Polytetrafluoropropylene copolymer). A recording paper with an unfixed toner image developed thereon passes nip portion formed between the fixing roller and the heat-resistant sheet for fixing the toner image thereon by fusing.

The pressure-pad type fixing device encounters a problem that the heat-resistant sheet is easy to wear by friction with the fixing roller and paper and therefore has a relatively short service life. Furthermore, the heat-resistant sheet must be made of correctly selected material according to an adequate design so that it can well release toner therefrom, smoothly feed paper (with no friction) and facilitates fixing the toner image on paper by the fixing roller

SUMMARY OF THE INVENTION

It is an object of the present invention is to provide a toner image fixing device that is provided with a heat-resistant sheet that is wear-resistant and can realize correct and reliable work for feeding paper and fixing a toner image thereon.

It is an object of the present invention is to provide a toner image fixing device which fixes a toner image on a recording material passing through nip portion formed between a fixing roller and a heat-resistant sheet with a pressure member and wherein the heat-resistant sheet is made of synthetic resin PTFE containing polyimide.

It is an object of the present invention to provide a toner image fixing device, using a heat-resistant sheet made of material PTFE containing polyimide, which sheet can satisfactory transport recording paper, release toner particles therefrom and has a high durability (wear-resistance).

PREFERRED EMBODIMENT OF THE INVENTION

Figure 1:
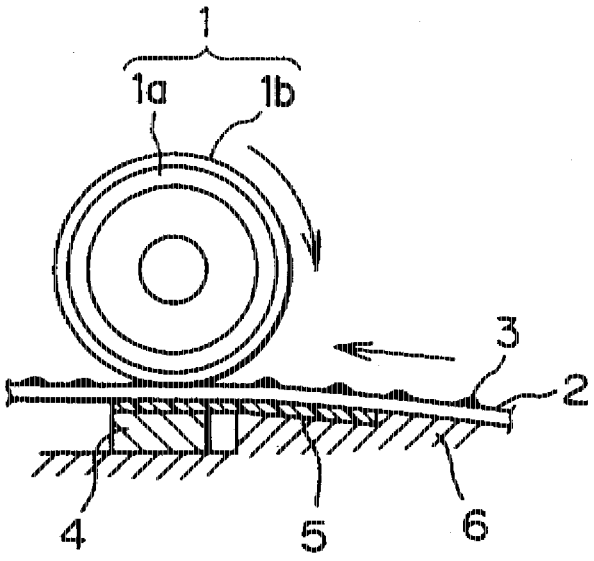
FIG.1 ( PRIOR ART )
FIG. 1 is a construction view of a toner image fixing device using a pressure pad system.

Referring to FIG. 1, an example of a pressure pad type toner image fixing device is explained as follows: A fixing roller 1 is a thin-wall aluminum cylinder 1*a* whose external surface is coated all over with well-releasable, paper-guiding heat-resistant synthetic resin 1*b*, e.g., heat-resistant silicone rubber having a large friction coefficient. A pressure member 4 is disposed under the fixing roller 1. A heat-resistant sheet 5 on a lower frame 6 is interposed between the pressure member 4 and the fixing roller 1. The heat-resistant sheet 5 is made of a 100 micron thick glass fiber base coated or impregnated with well-releasable and heat-resistant synthetic resin, e.g., fluorocarbon resin: PFA (Tetrafluoroethylene-fluoroalkylvinylether copolymer), PTFE (Polytetrafluoroethylene) and FET (Polytetrafluoroethylene-Polytetrafluoropropylene copolymer). A recording paper 2 with an unfixed toner image 3 developed thereon passes nip portion formed between the fixing roller 1 and the heat-resistant sheet 5 for fixing the toner image thereon by fusing.

The pressure-pad type fixing device encounters a problem that the heat-resistant sheet is easy to wear by friction with the fixing roller and paper and therefore has a relatively short service life. Furthermore, the heat-resistant sheet must be made of correctly selected material according to an adequate design so that it can well release toner therefrom, smoothly feed paper (with no friction) and facilitates fixing the toner image on paper by the fixing roller.

In view of the foregoing, the present invention was made to provide a toner image fixing device that is provided with a heat-resistant sheet that is wear-resistant and can realize correct and reliable work for feeding paper and fixing a toner image thereon.

A toner image fixing device according to the present invention, which fixes a toner image on a recording material passing through nip portion formed between a fixing roller and a heat-resistant sheet with a pressure member and wherein the heat-resistant sheet is made of synthetic resin PTFE containing polyimide. The particularly desirable content of polyimide is of 3 to 7%.

In the above-mentioned fixing device, there is applied the heat-resistant sheet of 200 to 400 microns in thickness.

According to the present invention, the heat-resistant sheet is made of material PTFE containing polyimide, which sheet can satisfactory transport recording paper, release toner particles therefrom and has a high durability (wear-resistance).

The 200 to 400 micron thick heat-resistant sheet possesses both satisfactory fixing ability and durability.

Referring FIGS. 2 to 4, a preferred embodiment of the present invention will be described as follows:

A toner fixing device according to the present invention is used by way of an example in a laser printer.

Figure 2:
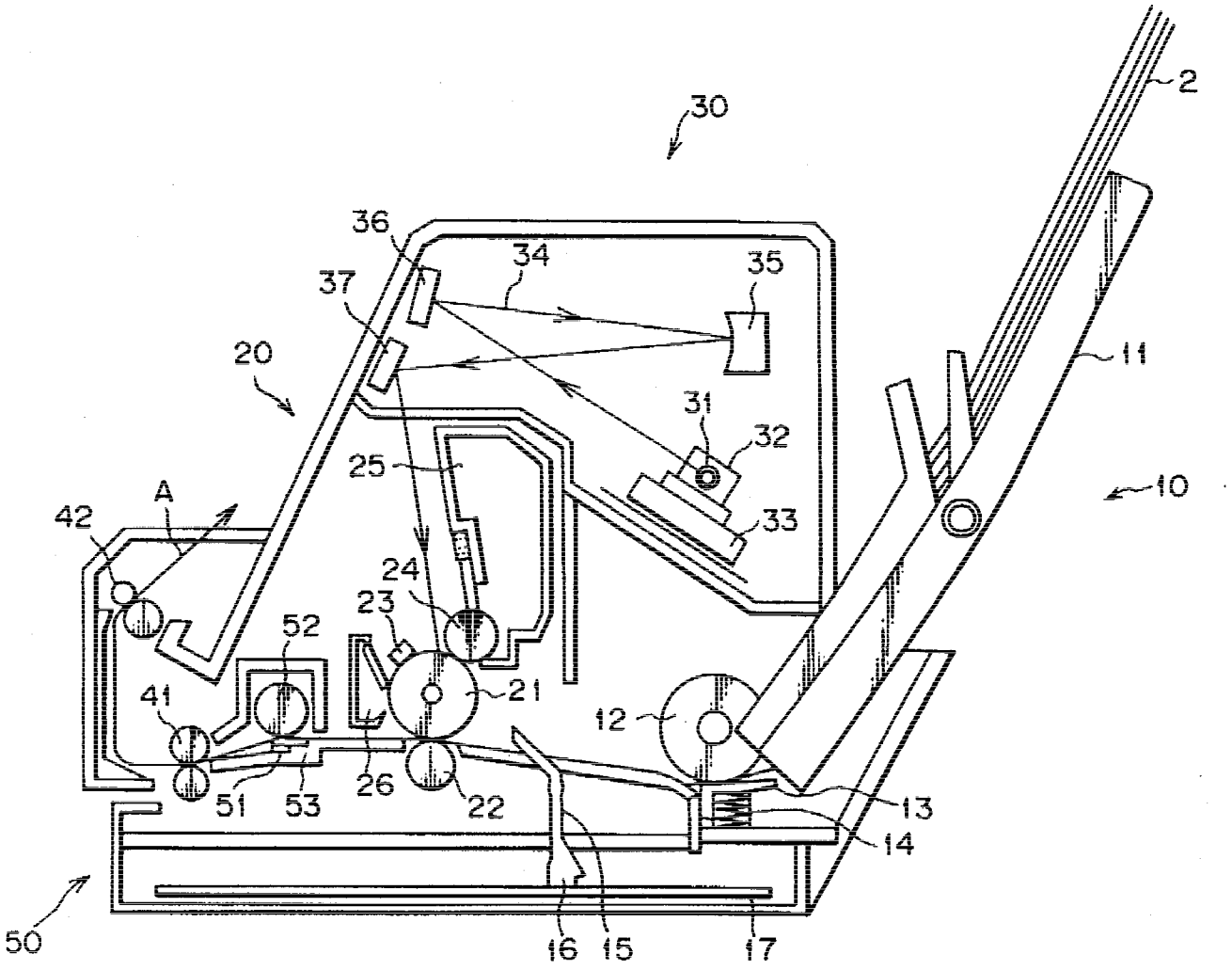
FIG. 2 is a diagrammatic view showing a general construction of a laser printer in which a toner-image fixing device according to the present invention is used.

As shown in FIG. 2, the laser printer has a paper feeding portion 10, an image forming device 20, a laser scanning portion 30 and a toner image fixing device 50 embodying the present invention.

The paper feeding portion 10 feeds recording paper 2 into the image forming device 20 disposed in the printer body. The image forming device transfers a toner image onto the recording paper 2 that is further fed to the toner fixing device 50 wherein the toner image is fixed by heat on the recording paper 2. The recording paper with a toner image fixed thereon is then delivered out of the printer by delivery rollers 41 and 42. The path along which the recording paper traveled in the printer is shown by a bold line with an arrow A in FIG. 2.

The paper feeding portion 10 is composed of a paper feeding tray 11, a paper feeding roller 12, paper separating friction plate 13, pressure spring 14, paper sensor actuator 15, a paper sensor 16 and a control circuit.

When a command "Print" is given to the paper feeding portion 11, recording paper sheets 2 piled on paper feeding tray 11 is fed one by one by the effect of the paper feeding roller 12, paper feeding friction plate 13 and pressure spring 14 into the body of the printer. In the printer, the recording paper 2 kicks down the paper sensor actuator 15 that causes the optical paper-sensor 16 to generate an electrical signal to start an image printing process. The control circuit 17 driven by the section of the paper sensing actuator 15 transmits an image signal to a light-emitting laser diode unit 31 of the laser scanning portion 30 and controls the ON-OFF operation of the light-emitting diodes.

The laser scanning portion 30 comprises a light-emitting laser-diode unit 31, a scanning mirror 32, a scanning mirror motor 33 and reflecting mirrors 35, 36 and 37.

The scanning mirror 32 is driven by the scanning mirror motor 33 to rotate at a high constant rotation speed. In FIG. 2, laser light 34 scans in a vertical direction relative to the paper surface. The laser light 34 emitted from the light-emitting laser-diode unit 31, reflects by the reflecting mirrors 36, 35 and 37 in turn and falls onto a light-sensitive body 21. At this time, the laser light 34 selectively exposes the surface of the light-sensitive body 21 according to ON-OFF information given from the control circuit 17.

The image forming device 20 is composed of a light-sensitive body 21, an image transfer roller 22, an electrically charging member 23, a developing roller 24, a developing unit 25 and a cleaning unit 26.

The light-sensitive body's surface electrically charged in advance by the electrically charging member 23 is selectively discharged by the laser light 34 to form a latent image thereon. In the developing unit 25, toner stored therein is electrically charged by suitable stirring and is then fed to the developing roller 24 by which a toner image is formed on the light-sensitive body 21 according to the static latent image by the effect of a developing bias voltage given to the developing roller 24 and an electric field produced by potentials on the light-sensitive body 21.

The recording paper 2 fed by the paper feeding portion 10 enters a path between the light-sensitive body 21 and the image transfer roller 22. An image developed with toner on the light-sensitive body 21 is transferred onto the recording paper 2 by the effect of an electric field produced by a voltage applied to the image transfer roller 22 when the paper passes the path between the light-sensitive body 21 and the image transfer roller 22. Unused toner is collected by the cleaning unit 26.

The recording paper 2 carrying the transferred thereon toner image 3 is then fed to a toner image fixing device 50 wherein the recording paper 2 is suitably pressed by a pressure member 51 and, at the same time, is heated by a fixing roller 52 whose surface is heated and kept at a constant temperature of 155° C. The toner image 3 is thus fixed by fusing on the recording paper 2. The recording paper 2 with the fixed toner image is delivered by the delivery rollers 41 and 42 out of the printing machine.

Figure 3:
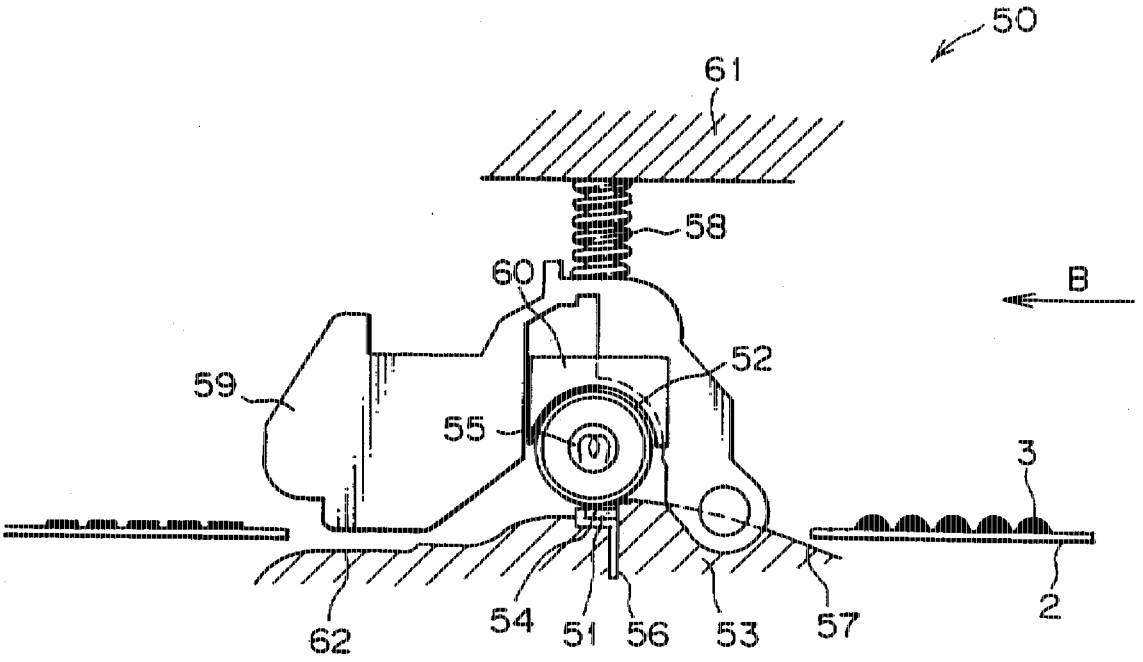
FIG. 3 is a view for explaining a whole system of a toner image fixing device according to the present invention.
Figure 4:
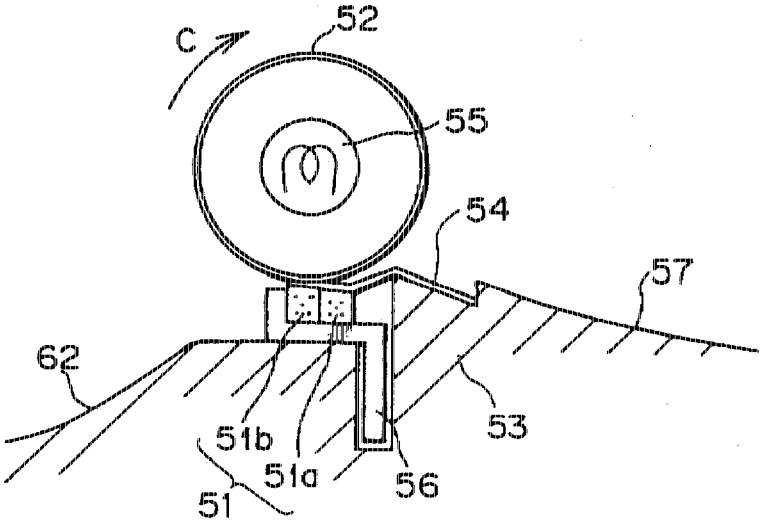
FIG. 4 is a detailed view showing an essential portion of the toner image fixing device of FIG. 3.

Referring to FIGS. 3 and 4, the above-mentioned toner-image fixing device is described in detail as follows:

FIG. 3 is a general view of the toner image fixing device 50 and FIG. 4 is a detailed view of an essential portion of the toner-image fixing device 50.

As shown in FIG. 3, the toner fixing device 50 has a pressure member 51, a fixing roller 52 and a lower frame 53. The fixing roller 52 has a thin-wall aluminum cylindrical body (outside diameter 14 mm and wall thickness 0.55 mm) externally covered with a layer of synthetic resin having well-releasable and heat-resistant properties. A heater-lamp 55 is coaxially inserted in the fixing roller body. The fixing roller 52 is supported at both ends on semi-circular bearings 60 disposed at a normal angle with the fixing roller axis. The bearings 60 are fitted in a fixing cover 59 made of heat-resistant resin. The fixing cover 59 is pressed through pressure springs 58 (pressing force 1200 gf each) by an upper frame 61.

As shown in FIG. 4, the pressure member 51 is composed of two elastic members, one of which is a 2 mm thick and 2 mm wide silicon sponge-rubber member 51*a* disposed at an upstream side of the paper feeding path and the other is a 3 mm thick and 2 mm wide silicone sponge-rubber member 51*b* disposed at the downstream side of the paper feeding path. These pressure members 51*a* and 51*b* are arranged between a Z-bent metal plate 56 (1.2 mm thick plate of stainless steel SUS304) and an external cylindrical surface of the fixing roller 52 and pressed against the fixing roller by the force of the pressure springs 58. The pressure members 51*a* and 51*b* are secured to the Z-bent metal plate 56 by using a double coated adhesive tape (ET tape produced by Nissan Packing Company). The Z-bent metal plate 56 is engaged with bosses formed on the lower frame 53 at both its ends.

The above-mentioned construction of the pressure member 51 is adopted for: (1) increasing the fixing ability by increasing nip width and (2) easily catching a front edge of paper by decreasing pressure to the upstream side pressure member. The Z-shape of the metal plate 56 is to increase its strength and prevent the pressure member from falling down when paper passes the fixing device. The pressure member 51 will be referred hereinafter to as a stepped pressure member.

A heat-resistant sheet 54 is secured to the lower frame 53 by a double coated adhesive tape and inserted between the upper pressure member 51 and the fixing roller 52.

In the above-mentioned toner-image fixing device 50, the fixing roller 52 rotates in the direction C indicated by an arrow, being heated internally by the heater-lamp 55 and controlled by a control unit (not shown) to keep its surface temperature at 155° C. A recording paper 2 carrying a developed and unfixed toner image 3 thereon enters into nip portion of the fixing device (in the section indicated by an arrow B in FIG. 3). The recording paper is advanced by rotation of the fixing roller 52 since a frictional force between the fixing roller 52 and the recording paper 2 is larger than a frictional force between the recording paper 2 and the heat-resistant sheet 54. The toner image is fixed by heat on the recording paper while the paper passes the fixing device.

In the fixing device, the heat-resistant sheet must bear frequent friction with the fixing roller 52 and the recording paper 2 and therefore must have a high wear-resistance. But, application of an excessively durable heat-resistant sheet causes wearing of the resin layer of the fixing roller. The heat-resistant sheet must smoothly feed recording paper therealong and be easily releasable from toner particles. Accordingly, we have studied material for making a heat-resistant sheet that can satisfy the above-mentioned requirements.

Synthetic resin PTFE (Polytetrafluoroethylene) with various kinds of fillers added thereto for improving wear-resistance was examined. The test results are shown in Table 1.

TABLE 1

| Material | Sliding friction | Toner Releasing | Wear Resistance | Effect on Fixing Roller |
|---|---|---|---|---|
| PTFE | ○ | ○ | X | ○ |
| PTFE + Boron | ○ | ○ | Δ | ○ |
| PTFE + Luron | X | – | – | – |
| PTFE + Graphite | X | – | – | – |
| PTFE + Molybdenum | X | ○ | ○ | X |
| PTFE + Carbon | ○ | ○ | ○ | X |
| Fiber + Boron | ○ | ○ | ○ | Δ |
| PTFE + Spherical Carbon Fiber + Boron | | | | |
| PTFE + Carbon Black | ○ | ○ | Δ | ○ |
| PTFE + Polyimide | ○ | ○ | ○ | ○ |
| PTFE + Polyimide + Boron | ○ | X | – | – |

1) A mark "–" indicates data not yet valued.

2) The sliding friction of paper on each heat-resistant sheet was tested on a printer by using various kinds of paper (plain paper, envelop, paper of 52 g/m$^2$, paper of 128 g/m$^2$, OHP, label paper). A sheet material that could transport all kinds of paper with no trouble is indicated with a mark ○ (Good). A sheet material that caused any kind of trouble, e.g., mis-nipping, slipping out and so on is indicated with a mark x (Bad).

3) The toner releasing property of the sheet material is tested by forcibly contaminating the heat-resistant sheet with toner and visually checking the extent of adhering toner particles thereto. A heat-resistant sheet to which very few particles adhered is indicated with a mark ○ (Good) whilst a heat-resistant sheet to which a large number of particles adhered is indicated wit a mark x (Bad).

4) The wear resistance of each heat-resistant sheet material was tested by printing 20000 sheets of recording paper. The evaluation was made according to wear amount Cs of material as follows:

○ (Good) when Cs≦80 microns;

Δ (Mean) when 80 microns≦Cs≦120 microns; and x (Bad) when 120 microns≦Cr.

5) The negative effect on a fixing roller was examined by printing 20000 sheets of recording paper. The evaluation was made according to wear amount Cr of the coat of the fixing roller as follows:

○ (Small) when Cr≦5 microns;

Δ (Mean) when 1.5 microns≦Cr≦5 microns; and x (Large) when 5 microns≦Cr.

The test results shown in Table 1 indicate that PTFE with polyimide fillers added thereto satisfies all requirements.

The amount of polyimide added to PTFE was examined. The examination results are shown in Table 2.

TABLE 2

| Added amount of Polyimide (%) | Sliding friction | Toner Releasing Property | Wear Resistance | Effect on Fixing Roller |
|---|---|---|---|---|
| 1.0 | ○ | ○ | Δ | ○ |
| 3.0 | ○ | ○ | ○ | ○ |
| 5.0 | ○ | ○ | ○ | ○ |
| 7.0 | ○ | ○ | ○ | ○ |
| 10.0 | X | ○ | ○ | ○ |

The test results (Table 2) indicate that increasing the content of polyimide in PTFE increases the friction resistance of the material with paper and decreasing the content of polyimide in PTFE decreases the wear resistance of the material. The optimal content of polyimide in PTFE is 3 to 7%.

The thickness of the heat-resistant sheet was studied. The results were shown in Table 3.

TABLE 3

| Thickness of heat-resistant sheet of PTFE + Polyimide 5% | Fixing Ability | Nipping Ability | Service Life (Prints) |
|---|---|---|---|
| 100 | ○ | X | 20000 |
| 200 | ○ | ○ | 48000 |
| 300 | ○ | ○ | 75000 |
| 400 | ○ | ○ | 110000 |
| 500 | X | ○ | 150000 |

1) The fixing ability of the heat-resistant sheet was tested by rubbing the fixed image on the recording paper. The fixing ability was evaluated with a mark ○ (Good) if the residual portion after rubbing test is not less than 80% and with a mark x (Bad) if the residual portion is less than 80%.

2) The nipping ability of each heat-resistant sheet was tested with various kinds of paper (plain paper, envelop, paper of 52 g/m$^2$, paper of 128 g/m$^2$, OHP, label paper). A heat-resistant sheet that could catch all kinds of paper with no trouble is indicated by a mark ○ (Good). A heat-resistant sheet that caused insufficient nipping is indicated with a mark x (Bad).

The test results shows that a thick heat-resistant sheet (500 microns or more) has a decreased flexibility and can not obtain enough nip width, causing decreasing of the fixing ability, whereas a thin heat-resistant sheet (100 microns or less) forms an excessively wide nip causing decrease the nipping ability. The thin heat-resistant sheet has a short service life. Accordingly, an optimal thickness of the heat-resistant sheet is 200 to 400 microns. In the described embodiment of the present invention, a heat-resistant sheet of 300 microns in thickness is used.

As is apparent from the foregoing, the toner fixing device according to the present invention (claim 1) is characterized by using a heat-resistant sheet made of synthetic resin PTFE containing polyimide, which has satisfactory property of feeding recording paper and releasing toner particles and has a high durability wear resistance).

The toner fixing device according to the present invention is characterized by using a heat-resistant sheet made of synthetic resin PTFE containing polyimide by 3 to 7%, which has a stabilized paper feeding property and a high durability (wear resistance).

The toner fixing device according to the present invention is characterized by using a heat-resistant sheet made of synthetic resin PTFE containing polyimide and having thickness of 200 to 400 microns, which assures both satisfactory fixing ability and durability.

We claim:

1. A toner image fixing device for fixing by heat a toner image formed on a recording medium, which is provided with a fixing roller, a pressure member disposed as pressed against the fixing roller, and a heat-resistant sheet secured between the fixing roller and the pressure member for guiding the recording medium carrying an unfixed toner image thereon and which is wherein the heat-resistant sheet is made of synthetic resin which base is PTFE (Polytetrafluoroethylene) containing polyimide.

2. A toner image fixing device as defined in claim 1, wherein a polyimide content of the heat-resistant sheet is in a range of 3 to 7 percent.

3. A toner image fixing device as defined in claim 2, wherein the heat-resistant sheet has a thickness of 200 to 400 microns.

* * * * *